US007215308B2

(12) United States Patent
Orii et al.

(10) Patent No.: US 7,215,308 B2
(45) Date of Patent: May 8, 2007

(54) DISPLAY DRIVE METHOD, DISPLAY ELEMENT, AND DISPLAY

(75) Inventors: Toshihiko Orii, Kanagawa (JP); Osamu Akimoto, Tokyo (JP); Hitoshi Abe, Kanagawa (JP); Tooru Yokokura, Kanagawa (JP)

(73) Assignee: Sony Corporation, Tokyo (JP)

( * ) Notice: Subject to any disclaimer, the term of this patent is extended or adjusted under 35 U.S.C. 154(b) by 453 days.

(21) Appl. No.: 10/398,489

(22) PCT Filed: Aug. 8, 2002

(86) PCT No.: PCT/JP02/08110

§ 371 (c)(1),
(2), (4) Date: Oct. 7, 2003

(87) PCT Pub. No.: WO03/015070

PCT Pub. Date: Feb. 20, 2003

(65) Prior Publication Data

US 2004/0051688 A1 Mar. 18, 2004

(30) Foreign Application Priority Data

Aug. 8, 2001 (JP) ..... 2001-240344

(51) Int. Cl.
*G09G 3/36* (2006.01)

(52) U.S. Cl. ..... 345/87; 345/91; 345/94; 345/98; 345/99

(58) Field of Classification Search ..... 345/87, 345/98, 91, 94, 99
See application file for complete search history.

(56) References Cited

U.S. PATENT DOCUMENTS

| | | | | |
|---|---|---|---|---|
| 6,297,792 | B1 * | 10/2001 | Takahashi | 345/91 |
| 6,314,044 | B1 * | 11/2001 | Sasaki et al. | 365/230.03 |
| 6,556,162 | B2 * | 4/2003 | Brownlow et al. | 341/145 |
| 6,906,575 | B2 * | 6/2005 | Tanaka | 327/536 |

FOREIGN PATENT DOCUMENTS

| | | |
|---|---|---|
| EP | 0 541 364 | 5/1993 |
| EP | 0 559 321 | 9/1993 |
| JP | 4-236516 | 8/1992 |
| JP | 9 258170 | 10/1997 |
| JP | 10-104569 | 4/1998 |
| JP | 10-104569 A * | 4/1998 |
| JP | 11-308091 | 11/1999 |

* cited by examiner

*Primary Examiner*—Richard Hjerpe
*Assistant Examiner*—Leonid Shapiro
(74) *Attorney, Agent, or Firm*—Frommer Lawrence & Haug LLP; William S. Frommer; Thomas F. Presson

(57) ABSTRACT

A voltage to be used for scanning of scanning lines can be changed over between AVD1 which is within a gate withstanding voltage of a switching element and AVD2 higher than the gate withstanding voltage. Within a horizontal blanking period, scanning of the scanning lines is started with AVD1, and then precharging of data lines is performed. Thereafter, the voltage is changed over to AVD2. Since, at this point of time, a potential corresponding to the precharge voltage is generated in a pixel capacitor, even if AVD2 exceeding the withstanding voltage is applied to a pixel switch, a potential difference which does not exceed the withstanding voltage can be produced between terminals of the switching element.

8 Claims, 5 Drawing Sheets

DISPLAY DRIVE METHOD, DISPLAY ELEMENT, AND DISPLAY

TECHNICAL FIELD

This invention relates to a display driving method applied to a case wherein an image is displayed, for example, by an active matrix system. More particularly, the present invention relates to a substrate apparatus on which pixel driving cells and so forth arrayed in a matrix are disposed in accordance with such a display driving method as just mentioned and a display apparatus compatible with such a display driving method as described above.

BACKGROUND ART

A liquid crystal display apparatus which adopts an active matrix system is adopted widely, for example, in liquid crystal projector apparatus, liquid crystal display apparatus and so forth.

In such a liquid crystal display apparatus according to an active matrix system as just described, pixel cell driving circuits each including a pixel switch formed from, for example, a MOS transistor and a pixel capacitor connected to the pixel switch are formed, for example, on a semiconductor substrate in such a manner that they are arranged in a matrix. In short, a plurality of scanning lines are disposed along a horizontal (row) direction while a plurality of data lines are disposed in a vertical (column) direction. Further, a pixel cell driving circuit is connected at a position corresponding to each of intersecting points between the scanning lines and the data lines. Further, an opposing substrate on which common electrodes are formed is disposed in an opposing relationship to the semiconductor substrate, and liquid crystal is enclosed between the semiconductor substrate and the opposing substrate. Such a structure as just described is used to form a liquid crystal display apparatus.

Driving for image display of such a liquid crystal display apparatus as described above is described below briefly.

To the scanning lines disposed in the horizontal direction, a voltage of a predetermined level is successively applied, for example, for each one horizontal scanning period. In short, sequential scanning of the scanning lines is performed. In this instance, a plurality of pixel switches connected to a scanning line being scanned are placed into an on-state. Simultaneously, the data lines are driven within one horizontal scanning period. In short, a voltage based on data is applied to each of the data lines. It is to be noted that, thereupon, data line driving according to a so-called sequential driving system wherein data are successively applied to the data lines is usually performed.

The data applied in this manner are accumulated as charge through those pixel switches, which are placed in an on-state in such a manner as described above, as charge into the corresponding pixel capacitors. In short, writing of data into pixel cells for one horizontal line is performed. After writing of data is performed in this manner, a potential difference appears between the charge accumulated in each of the pixel capacitors and a Vcom applied to a corresponding opposing electrode, and the liquid crystal enclosed between the pixel capacitor and the opposing electrode is excited by the potential difference. In short, driving of the pixel cell is performed.

Such driving of the pixel cells for each one scanning line is executed each time the scanning lines are successively scanned thereby to display an image, for example, for one screen.

Further, in display driving of a liquid crystal display apparatus, driving is usually performed in such a manner that deterioration of the liquid crystal by application of a dc voltage to the liquid crystal is prevented. One of such ac driving systems, polarity reversal driving is known wherein pixel data is reversed to the positive polarity side and the negative polarity side with respect to the Vcom to drive each pixel. For the timing of the reversal driving, a frame reversal method wherein the polarity is reversed in a unit of a frame, a line reversal method wherein the polarity is reversed for each horizontal line, a dot reversal method wherein the polarity is reversed for each pixel cell (dot) and so forth are available.

Incidentally, in recent years, increase in definition and miniaturization of a liquid crystal display apparatus have been and are being promoted. In this instance, however, since the number of pixels per unit area increases, it cannot be avoided that the period of time permitted to write data signal into a pixel capacity becomes short. Therefore, such a problem that insufficiency of the gradation, color shading, degradation of the color reproducibility and so forth occur is liable to occur from a failure to write a data signal up to a necessary potential in the permitted period of time.

In order to eliminate such a problem as just described, it is necessary to raise the driving rate higher than ever. To this end, for example, not only increase of the number of scanning lines to be scanned or driven at a time but also, also in this instance, application of a higher gate voltage to each pixel switch can be listed as a countermeasure. According to this, refreshment of each pixel is performed at a higher rate.

However, the signal of image data applied to each data line varies at a predetermined timing within a range between a predetermined positive polarity maximum amplitude level and a predetermined negative polarity maximum amplitude level around the Vcom as described hereinabove. For example, a pixel switch is in most cases formed from a transistor of the N channel type or the P channel type, and in such an instance, in order to prevent a drop of the writing rate of a data signal by an increase of the on-resistance, a gate voltage higher than the amplitude of the image data signal must be applied.

Then, if a gate voltage of a further high level is applied from the circumstances described above, then specifications of a semiconductor process wherein transistors of a higher voltage withstanding property are formed must be employed.

For example, if the number of pixels per unit area is increased in order to raise the definition of or miniaturize a liquid crystal display apparatus, then the size of the individual pixel cells becomes smaller, and consequently, also the size of, for example, each pixel switch becomes smaller. However, from the characteristic of a semiconductor process, as the size of a transistor decreases, the voltage withstanding property of the transistor is obliged to decrease.

On the other hand, if it is intended to increase the voltage withstanding property in a semiconductor process, then the size of elements such as transistors is obliged to increase. Therefore, it becomes rather difficult to achieve such increase in definition and miniaturization of a liquid crystal display apparatus as described above from a reason that such increase of the size as mentioned above makes it difficult to assure a pixel capacitor or the like. In short, the miniaturization and the increase of the withstanding voltage have a mutually contradictory relationship. Further, since also modification to specifications in a semiconductor process from current specifications is involved, the increase of the withstanding voltage is inferior also in terms of the cost.

However, if a CMOS configuration is adopted for the pixel switches, then the gate withstanding voltage may be set to a gate withstanding property higher than the signal amplitude of the positive polarity or the negative polarity. Also in this instance, however, since the size of the transistors in the form of CMOS transistors becomes large, it is difficult to achieve increase of the definition and miniaturization, and a high cost is required similarly. Further, particularly since the junction capacitance of the pixel switches connected to the scanning lines and the data lines increase, it becomes difficult to raise the speed of data writing into the pixel capacitors.

Further, where a liquid crystal display apparatus adopts transistors of the N channel type or the P channel type for the pixel switches, the gate threshold voltage is raised by a so-called back bias effect. Therefore, even if a certain prescribed gate voltage is applied, the range of the effective gate voltage is narrowed by the gate threshold voltage raised as described above. If the liquid crystal is driven with the gate voltage whose range is reduced in this manner, then also the range of the reaction of the liquid crystal with the driving voltage level is narrowed, and also the gradation representing property is deteriorated as much.

Thus, as one of methods of eliminating such problems with regard to the characteristics as a liquid crystal display apparatus as described above, it is a possible idea to apply a higher gate voltage to the pixel switches as described hereinabove. However, if it is tried to realize this, then problems in a semiconductor process arise similarly as described hereinabove.

Where such problems as described above are taken into consideration, it is desirable to maintain the withstanding voltage of the transistors of the pixels switches as standards in a semiconductor process and besides make it possible to perform display driving which allows, for example, application of a higher gate voltage than ever.

DISCLOSURE OF INVENTION

Therefore, according to the present invention, a display driving method is configured in the following manner taking the subject described above into consideration.

In particular, in a display driving method for a display element wherein a plurality of scanning lines and data lines extending perpendicularly to the scanning lines for being supplied with a data signal corresponding to pixel data are disposed in a matrix and, at each of intersecting points between the scanning lines and the data lines, a pixel capacitor and a switching element for rendering conducting a route for supplying the data signal to the pixel capacitor by a scanning signal voltage applied to the scanning line are connected, a scanning step of starting application of the scanning signal voltage with a first amplitude level which is within an allowable level based on a withstanding voltage characteristic of the switching element, a precharging step of applying a precharge voltage of a predetermined level to the data lines before supply of data to the data lines is started after application of the scanning signal voltage of the first amplitude level is started, and an amplitude changeover step of changing over the scanning signal voltage being applied with the first amplitude level to a second amplitude level higher than the first amplitude level at a predetermined timing within a period within which a potential generated by the application of the precharge voltage is maintained are performed.

Meanwhile, a display element wherein a plurality of scanning lines and data lines extending perpendicularly to the scanning lines for being supplied with a data signal corresponding to pixel data are disposed in a matrix and, at each of intersecting points between the scanning lines and the data lines, a pixel capacitor and a switching element for rendering conducting a route for supplying the data signal to the pixel capacitor by the scanning signal voltage applied to the scanning line are connected is configured in the following manner.

In particular, it is configured such that it includes scanning line driving means for supplying a scanning signal voltage for scanning the scanning lines, data line driving means for supplying the data signal to the data lines, and precharge means for applying a precharge voltage of a predetermined level to the data lines before supply of data to the data lines is started after application of the scanning signal voltage of a first amplitude level is started, and that the scanning line driving means changes over the scanning signal voltage between the first amplitude level which is within an allowable level based on a withstanding voltage characteristic of the switching element and a second amplitude level higher than the first amplitude level at a predetermined timing within a period within which a potential generated by the application of the precharge voltage is maintained and applies the scanning signal voltage to the scanning lines.

Further, a display apparatus is configured in the following manner.

In particular, it comprises a semiconductor substrate on which a display element is formed, an opposing substrate having a common electrode disposed in an opposing relationship to the semiconductor substrate, and a liquid crystal layer interposed between the semiconductor substrate and the opposing substrate.

The display element includes pixel cell driving means wherein a plurality of scanning lines and data lines extending perpendicularly to the scanning lines for being supplied with a data signal corresponding to pixel data are disposed in a matrix and, at each of intersecting points between the scanning lines and the data lines, a pixel capacitor and a switching element for rendering conducting a route for supplying the data signal to the pixel capacitor by the scanning signal voltage applied to the scanning line are connected, scanning line driving means for supplying a scanning signal voltage for scanning the scanning lines, data line driving means for supplying the data signal to the data lines, and precharge means for applying a precharge voltage of a predetermined level to the data lines before supply of data to the data lines is started after application of the scanning signal voltage of a first amplitude level is started, and the scanning line driving means changes over the scanning signal voltage between the first amplitude level which is within an allowable level based on a withstanding voltage characteristic of the switching element and a second amplitude level higher than the first amplitude level at a predetermined timing within a period within which a potential generated by the application of the precharge voltage is maintained and applies the scanning signal voltage to the scanning lines.

With the configurations described above, the voltage to be used for scanning of the scanning lines is changed over between the first amplitude level which is within the allowable level based on the withstanding voltage characteristic of the switching element and the second amplitude level higher than the first amplitude level, for example, higher than the allowable level.

Then, after scanning of the scanning lines is started first with the scanning signal voltage of the first amplitude level which is within the withstanding voltage, precharging of the data lines is performed at a timing before supply of the data signal by data line driving is performed. Thereafter, the scanning signal voltage is changed over to the second amplitude level. However, at this point of time, a potential corresponding to the precharge voltage is generated in the pixel capacitor. Therefore, even if the second amplitude level exceeding the withstanding voltage is applied to the switching element, a potential difference which does not exceed the withstanding voltage can be produced between terminals of the switching element.

BEST MODE FOR CARRYING OUT THE INVENTION

In the following, an embodiment of the present invention is described. In the present embodiment, a liquid crystal display apparatus of the active matrix type which is adopted in various video apparatus and electronic apparatus beginning with, for example, a liquid crystal projector apparatus is given as an example.

Figure 1:
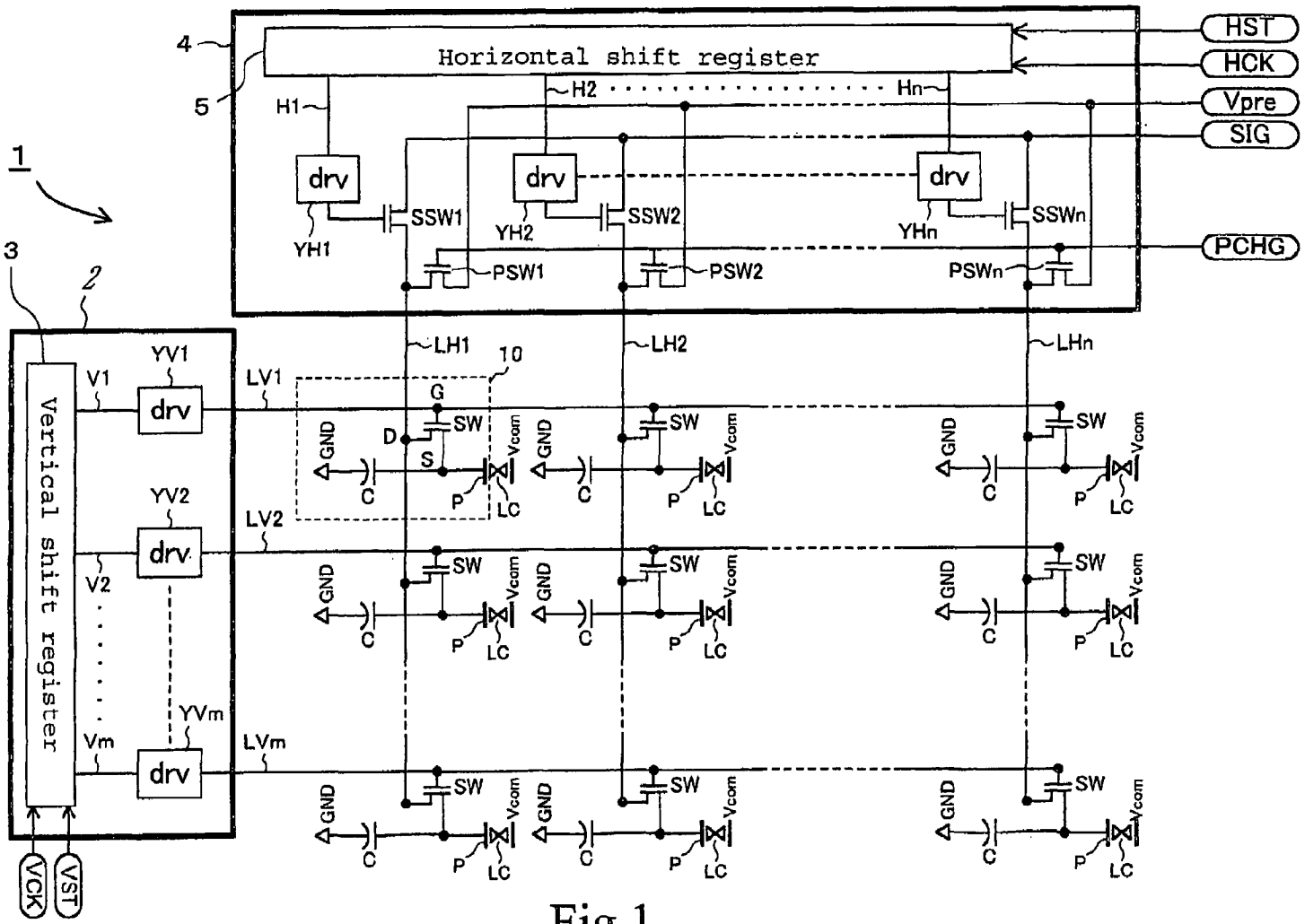
FIG. 1 is a circuit diagram showing an example of a configuration of a liquid crystal display apparatus as an embodiment of the present invention.

FIG. 1 shows an example of a configuration of a liquid crystal display apparatus of the embodiment of the present invention.

The liquid crystal display apparatus 1 shown in the figure has a general basic structure wherein required circuits beginning with at least pixel cell driving circuits arranged, for example, in a matrix are formed on a semiconductor substrate (display element). Further, the liquid crystal display apparatus 1 has a structure wherein an opposing substrate on which a common electrode is formed is disposed in an opposing relationship to the semiconductor substrate and liquid crystal is enclosed between the semiconductor substrate and the opposing electrode.

In the present embodiment, a liquid crystal display element of the reflection type is formed, and in such an instance, a substrate made of a material, for example, of silicon (Si) is used for the semiconductor substrate. On this semiconductor substrate, scanning lines LV1 to LVm are formed in a horizontal direction while data lines LH1 to LHn are formed in a vertical direction. Further, pixel cell driving circuits 10 are formed and arranged at intersecting points of the scanning lines and the data lines arranged in a matrix in this manner, and further, a scanning driver 2 and a data driver 4 are formed.

First, a circuit configuration of the pixel cell driving circuits 10 formed on the semiconductor substrate is described taking a location surrounded by a broken line in FIG. 1 as an example.

One pixel cell driving circuit 10 includes a pixel switch SW, a pixel capacitor C, and a pixel electrode P as shown in the figure.

The pixel switch SW has a structure, for example, of an N-channel transistor. The gate of the pixel switch SW is connected to the scanning line LV1 while the drain of the pixel switch SW is connected to the data line LH1.

Meanwhile, the source of the pixel switch SW is connected to a terminal of the pixel capacitor C. The other terminal of the pixel capacitor C in this instance is connected to the ground. Further, a node between the source of the pixel switch SW and the pixel capacitor C is connected to the pixel electrode P.

In this instance, a predetermined plural number of scanning lines (gate lines) LV1 to LVm are arranged in the horizontal (row) direction while a predetermined plural number of data lines LH1 to LHn are disposed in the vertical direction such that the scanning lines and the data lines are arranged in a matrix. In addition, for example, one of the pixel cell driving circuits 10 is connected in such a connection form as described above at a position which is an intersecting point between the scanning line LV1 and the data line LH1. Further, also the other pixel cell driving circuits 10 are arranged and formed such that they are individually connected at intersecting points between the other scanning lines LV2 to LVm and the data lines LH2 to LHn in a similar manner. In this manner, the pixel cell driving circuits 10 are arranged in a matrix along the row direction and the column direction in accordance with the array of the scanning lines and the data lines.

Further, on the semiconductor substrate formed in such a manner as described above, the pixel electrodes P of the pixel cell driving circuits 10 are arranged in a matrix.

Further, an opposing substrate on which a common electrode to which a common voltage Vcom is applied is formed is disposed in an opposing relationship to the semiconductor substrate formed with the pixel cell driving circuits 10 arranged in such a manner as described above. Further, liquid crystal LC is enclosed between the semiconductor substrate and the opposing substrate. The entire liquid crystal display apparatus 1 of the present embodiment is configured with such a structure as described above.

Also circuits as the scanning driver 2 and the data driver 4 are formed on the semiconductor substrate of the present embodiment.

The scanning driver 2 is provided to perform scanning for each row in the vertical direction. In particular, in order to perform image display, a pulse voltage (scanning pulse) as a scanning signal is outputted in order to the scanning lines LV1→LV2 . . . LVm for each one horizontal scanning period to successively scan the scanning lines in the vertical direction.

To this end, the scanning driver 2 includes, for example, as shown in the figure, a vertical shift register 3, and m drivers YV1 to YVm corresponding to the number m of the scanning lines.

A vertical start signal VST and a vertical clock signal VCK are inputted to the vertical shift register 3. The vertical start signal VST is outputted at a timing corresponding, for example, to a frame period and is a signal indicative of a start of vertical scanning within a one-frame period. Meanwhile, the vertical clock signal VCK is a clock signal outputted at a timing of each one horizontal scanning period.

The vertical shift register 3 starts shifting of the scanning signal in response to an instruction to start vertical scanning by the vertical start signal VST. Further, the shifting of the output is performed in accordance with an input timing of the vertical clock signal VCK.

Consequently, the vertical shift register 3 first outputs a scanning signal V1 in response to the vertical start signal VST, and thereafter outputs vertical scanning signals from a scanning signal V2 to a scanning signal Vm successively at timings of one-horizontal scanning periods.

The scanning signals V1 to Vm successively outputted in such a manner as described above are inputted to the drivers YV1 to YVm, respectively, and converted into and outputted as scanning pulses of a required voltage level by and from the drivers YV1 to YVm to the scanning lines LV1 to LVm, respectively.

In this manner, an operation of successively outputting scanning pulses to the scanning lines LV1 to LVm for each one-horizontal scanning period is obtained as described above. Then, if a scanning pulse is applied, for example, to the scanning line LV1, then a gate voltage of a predetermined level is applied to the gates of a plurality of pixel switches SW connected to the scanning line LV1 thereby to turn on the pixel switches SW.

It is to be noted that, in the present embodiment, a gate voltage of an amplitude higher than a withstanding voltage can be applied to the pixel switches. When such driving is performed, the drivers YV1 to YVm perform changeover of the output level of the scanning pulse in response to the polarity of the data signal. This is hereinafter described.

The data driver 4 is provided to drive the data lines LH1 to LHn. In other words, the data driver 4 outputs data signals to the data lines LH1 to LHn.

In this instance, the data driver 4 includes a horizontal shift register 5, and n drivers YH1 to YHn, n sampling switches SSW1 to SSWn and n precharge switches PSW1 to PSWn corresponding to the number n of the data lines. Also the sampling switches SSW1 to SSWn and precharge switches PSW1 to PSWn are formed, for example, from N-channel transistors similarly to the pixel switches.

Output lines for scanning signals H1 to Hn extend from the horizontal shift register 5 such that outputs of the scanning signals H1 to Hn are inputted to the drivers YH1 to YHn, respectively. Outputs of the drivers YH1 to YHn are connected to the gates of the sampling switches SSW1 to SSWn, respectively.

A data signal SIG is inputted to the drains of the sampling switches SSW1 to SSWn. Further, the sources of the sampling switches SSW1 to SSWn are connected to the data lines LH1 to LHn, respectively.

Further, in the present embodiment, driving is performed such that a gate voltage higher than a withstanding voltage can be applied to the pixel switches as described above. In a corresponding relationship to this, the data driver in the present embodiment includes a precharge circuit system for precharging the data lines and the pixel capacitors at a required timing.

The precharge circuit system in this instance includes the precharge switches PSW1 to PSWn. The gates of the precharge switches PSW1 to PSWn are connected commonly to a precharge timing signal PCHG, and the drains of the precharge switches PSW1 to PSWn are connected commonly to a precharge voltage Vpre. Further, the sources of the precharge switches PSW1 to PSWn are connected to the data lines LH1 to LHn, respectively.

Operation for driving the data lines by the data driver 4 is performed in the following manner. It is to be noted that operation of the precharge circuit system is not described here but is hereinafter described, and here, only basic operation for data line driving of the data driver 4 is described.

A horizontal start signal HST and a horizontal clock signal HCK are inputted to the horizontal shift register 5 in the data driver 4.

Driving of the data lines for each one horizontal line is started at a predetermined timing from a start point at a point of time at which the scanning driver 2 starts scanning of a certain one of the scanning lines, and the horizontal start signal HST mentioned above is used as a signal for indicating starting of the data line driving of the one horizontal line.

Meanwhile, the horizontal clock signal HCK is a clock having a so-called pixel frequency corresponding to the period for which, for example, pixels which form one horizontal line are successively scanned.

The horizontal shift register 5 starts outputting of scanning signals at a timing indicated by the horizontal start signal HST. In short, the horizontal shift register 5 performs outputting of the scanning signal H1. Then, within each later horizontal scanning period, the horizontal shift register 5 shifts the scanning signal in response to a timing of the horizontal clock signal HCK to successively output the scanning signals H2 to Hn. It is to be noted that the scanning signals have a signal waveform having a pulse width corresponding to the period of the horizontal clock signal HCK.

The scanning signals H1 to Hn successively outputted in this manner are inputted to the drivers YH1 to YHn, converted into voltages of a predetermined level by the drivers YH1 to YHn and successively applied as gate voltages to the sampling switches SSW1 to SSWn, respectively. Consequently, the sampling switches SSW1 to SSWn are placed into and exhibit an on-state for periods within which pulses of the scanning signals H1 to Hn are outputted. In other words, the sampling switches SSW1 to SSWn are successively placed into an on-state in accordance with output timings of the scanning signals H1 to Hn.

Here, the data signal SIG is applied to the drains of the sampling switches SSW1 to SSWn. The data signal SIG is a signal having a voltage value corresponding to pixel data.

Then, when the sampling switches SSW1 to SSWn are successively placed into an on-state at output timings of the scanning signals H1 to Hn in such a manner as described above, respectively, the data signal SIG is applied from the drains of the sampling switches SSW1 to SSWn through the sources of them to the data lines LH1 to LHn, respectively.

At this time, since the pixel switches SW connected to a certain one of the scanning lines which is active by the scanning are in an on-state, charge corresponding to the data successively applied to the data lines LH1 to LHn are accumulated into the pixel capacitors C of the pixel cell driving circuits 10 at the intersecting points between the scanning line and the data lines LH1 to LHn, respectively. In short, sampling (writing) of data is performed.

In each of the pixel capacitors C into which sampling of data is performed in such a manner as described above, a potential corresponding to the accumulated charge is generated, and this potential is generated also in the pixel electrode P connected to the source of the same pixel switch SW.

While the common electrode to which the common voltage Vcom is applied is disposed in an opposing relationship to the pixel electrode P with the liquid crystal LC interposed therebetween, when a potential corresponding to the data is generated in the pixel electrode P in such a manner as described above, the liquid crystal of the liquid crystal LC interposed between the pixel electrode P and the common electrode is excited in accordance with a potential difference between the potential of the pixel electrode P and the common voltage Vcom. In short, the pixel cell is driven to perform display in a unit of a cell.

Further, since liquid crystal is deteriorated by driving by application of dc as well known in the art, it is a common practice to use ac as a voltage to be applied to liquid crystal. Therefore, also in the liquid crystal display apparatus of the present embodiment, the liquid crystal is driven by application of ac. To this end, in the present embodiment, the data signal is applied in the form of an ac waveform while a voltage like a dc voltage of the common voltage Vcom is applied to the opposing electrode side.

Figure 2:
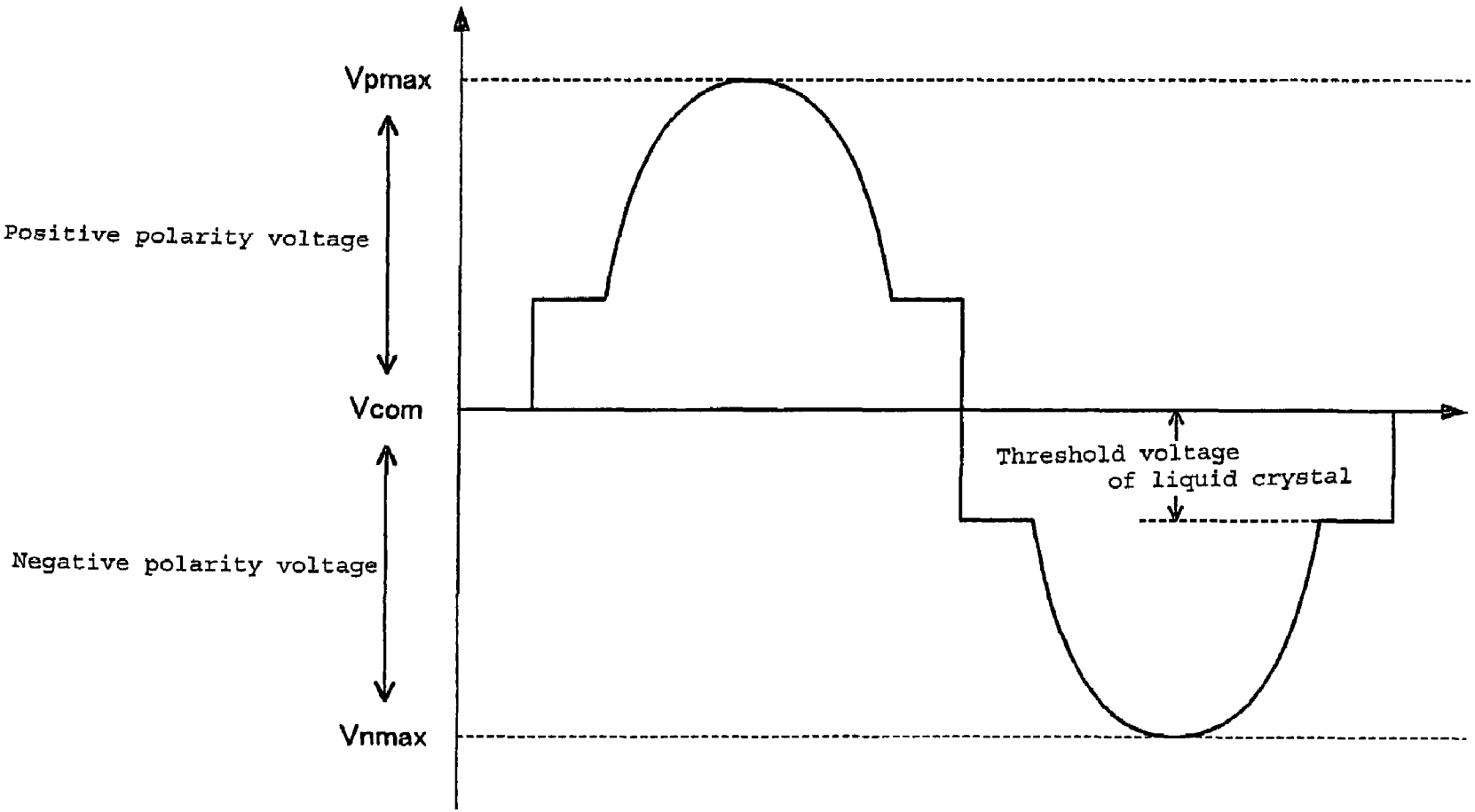
FIG. 2 is a waveform diagram illustrating a data signal whose polarity is reversed.

In particular, as the data signal in the present embodiment, a positive polarity signal which varies within a range up to a maximum value Vpmax on the positive polarity side with respect to the common voltage Vcom and a negative polarity signal which varies within another range up to a maximum value Vnmax on the negative side from the common voltage Vcom with respect to a center level provided by the common voltage Vcom are outputted alternately at predetermined timings as shown in FIG. 2.

It is to be noted that, while the timing of a reversal of the ac signal to be applied to the liquid crystal may be determined by a frame reversal method wherein the ac signal is reversed for each frame, a line reversal method wherein the ac signal is reversed for each horizontal line, a dot reversal method wherein the ac signal is reversed for each pixel (dot) or the like, the reversal method in the display driving according to the present invention is not particularly limited to any one of them. It is to be noted, however, that, in the description of the present embodiment, the frame reversal method is used.

When driving for image display by the liquid crystal display apparatus of the present embodiment having such a configuration as described above is performed, for example, a gate voltage higher than a rated withstanding voltage is applied to each of the pixel switches SW while a voltage within the withstanding voltage is applied between the gate and the source and between the gate and the drain. Consequently, a sufficiently high gate voltage can be applied to the pixel switches while the pixel switches are not broken by a voltage higher than the withstanding voltage.

Thus, in the following description, image display driving for achieving an application operation of such a gate voltage to the pixel switches is described.

Figure 3:
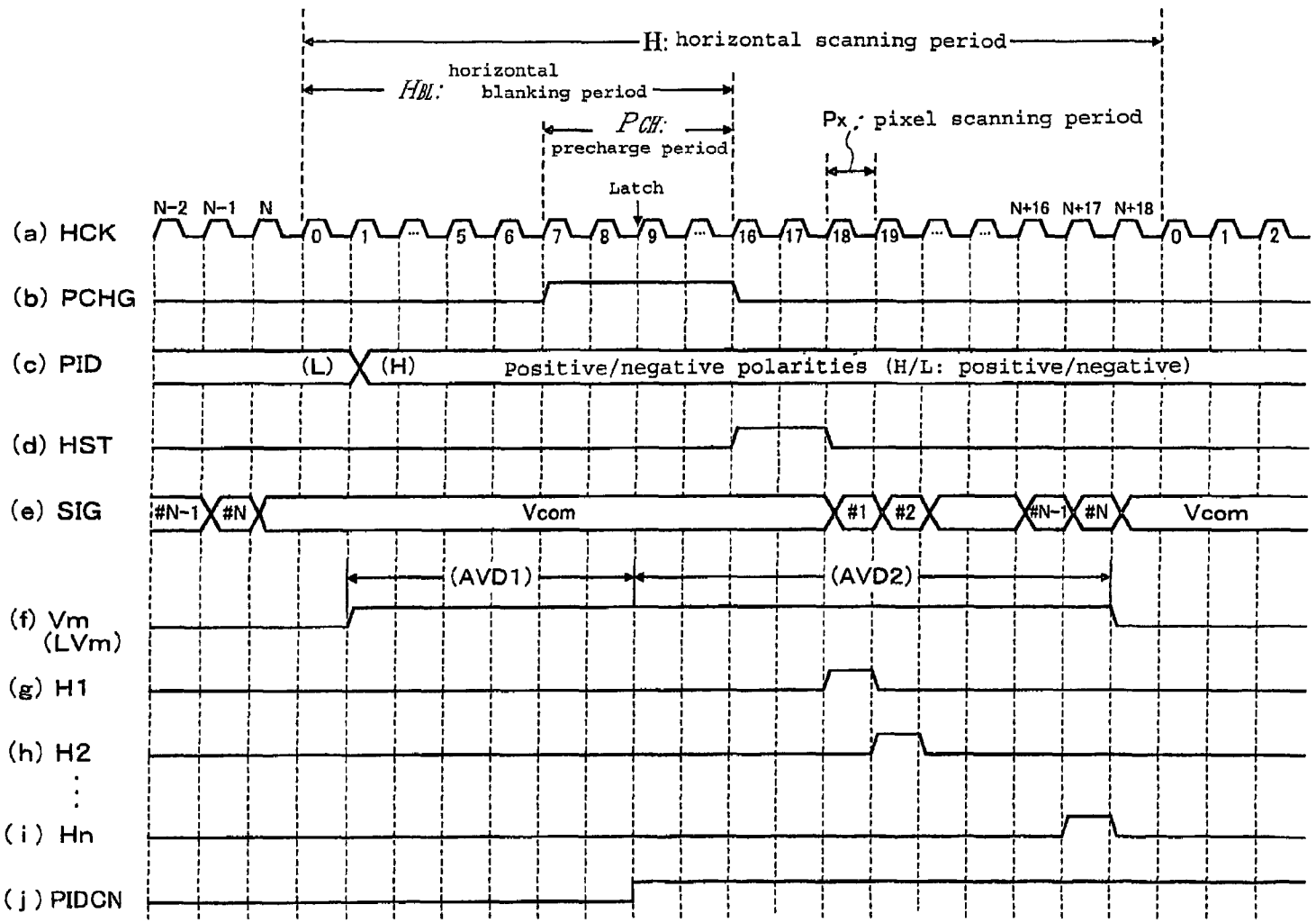
FIG. 3 is a timing chart illustrating a display driving timing of the liquid crystal display apparatus of the present embodiment.

FIG. 3 is a timing chart illustrating a driving timing within one horizontal scanning period as an image displaying operation of the liquid crystal display apparatus 1 of the present embodiment. It is to be noted that this figure illustrates driving timings when the scanning line LVm shown in FIG. 1 is scanned.

Referring to this figure, one horizontal scanning period H is a period within which the horizontal clock signals HCK of HCK(0) to HCK(N+15) shown in (a) of FIG. 3 are outputted. It is to be noted that the period corresponding to one period of the horizontal clock signal HCK here is referred to as pixel scanning period Px. Further, the scanning signal Vm is outputted as a voltage of a predetermined level within the period of HCK(1) to HCK(N+17) as shown in (f) of FIG. 3. As the scanning signal Vm is converted into a predetermined voltage level by the driver YVm and outputted to the scanning line LVm, the pixel switches SW connected to the scanning line LVm exhibit an on-state within the period of HCK(1) to HCK(N+17).

Further, while a polarity signal PID illustrated in (c) of FIG. 3 is a signal representative of the polarity of the data signal, where the polarity of the data signal is to be reversed, it changes from the H level to the L level or from the L level to the H level in accordance with the state of the reversal at the point of time of the horizontal clock signal HCK(1) within the one horizontal scanning period H. Here, the polarity signal PID has the H level when the data signal has the positive polarity but has the L level when the data signal has the negative polarity.

Here, a scanning period for 16 pixels from HCK(0) to HCK(15) in the beginning of the horizontal scanning period H is a horizontal blanking period HBL within which data writing into the pixel cells is not performed. Accordingly, the data signal SIG within this period keeps the common voltage Vcom of the center level as shown in (e) of FIG. 3.

Then, within the period of HCK(7) to HCK(15) in the latter half of the horizontal blanking period HBL, the precharge timing signal PCHG rises from the L level to a predetermined H level in such a manner as shown (b) of FIG. 3. Consequently, a gate voltage is applied to the gates of the precharge switches PSW1 to PSWn in the data driver 4, and the precharge switches PSW1 to PSWn are rendered conducting at a time.

After the precharge switches PSW1 to PSWn are rendered conducting at a time, the precharge voltage Vpre is applied to the data lines LH1 to LHn through the drain-source of the switches. At this time, since the pixel switches SW connected to the scanning line LVm are already in an on-state, charge corresponding to the precharge voltage Vpre is accumulated into the pixel capacitors C connected to the pixel switches SW. Further, also the data lines LH1 to LHn themselves are precharged with the precharge voltage Vpre. In short, a certain potential is produced in the data lines LH1 to LHn with the precharge voltage Vpre.

It is to be noted that the precharge voltage Vpre may be set arbitrarily taking the gate withstanding property of the pixel switches SW and the voltage level higher than the gate withstanding voltage to be applied to the gates of the pixel switches and so forth. Further, the precharge voltage Vpre need not necessarily have a fixed level, but rather, where the polarity of the data signal reverses for each frame by the frame reversal method as in the present embodiment, preferably the level of the precharge voltage Vpre should be changed over in response to the polarity of the data signal.

Further, the polarity signal PID is latched at a timing of HCK(9) within the horizontal blanking period HBL. Then, when the precharge timing signal PCHG drops to the L level at a timing of the horizontal clock signal HCK(15), the application of the precharge voltage Vpre to the data lines comes to an end. It is to be noted that, even after the application of the precharge voltage Vpre comes to an end, the potential produced in the pixel capacitors C and the data lines by the precharging operation is maintained, for example, until after it is discharged fully.

Then, when a pulse as the horizontal start signal HST illustrated in (d) of FIG. 3 is outputted within the succeeding period of HCK(16) to HCK(17), the horizontal shift register 5 shifts and outputs the horizontal start signal HST at a timing of the horizontal clock signal HCK. Consequently, the scanning signals H1, H2, . . . , Hn are successively outputted at timings of one-pixel scanning periods as shown in (g), (h) and (i) of FIG. 3. Then, as the scanning signals H1, H2, . . . , Hn are outputted in this manner, the data signal SIG is successively applied to the data lines LH1, LH2, . . . LHn at output timings of the scanning signals H1, H2, . . . , Hn.

The data signal SIG at this time is illustrated in (e) of FIG. 3.

For example, within a period of HCK(18) within which the scanning signal H1 is outputted and the data line LH1 is driven, the data signal SIG denoted as "#1" is outputted. Accordingly, within this period, the data signal (#1) is written into the pixel capacitor C of the pixel cell driving circuit positioned at the intersecting point between the scanning line LVm and the data line LH1. Thus, driving of the pixel cell positioned at the intersecting point between the scanning line LVm and the data line LH1 is performed thereby.

As such driving of a pixel cell is performed up to the data signal (#N) of the horizontal clock signal HCK(N+17), pixel display for one horizontal line corresponding to the scanning line LVm is performed. In short, line display is performed.

Then, since such operation for one horizontal scanning period is performed every time the scanning lines LV1 to LVm are successively scanned within one frame period, an image for one frame is displayed. Further, as such operation for each frame period is successively performed, images are successively displayed.

Figure 4:
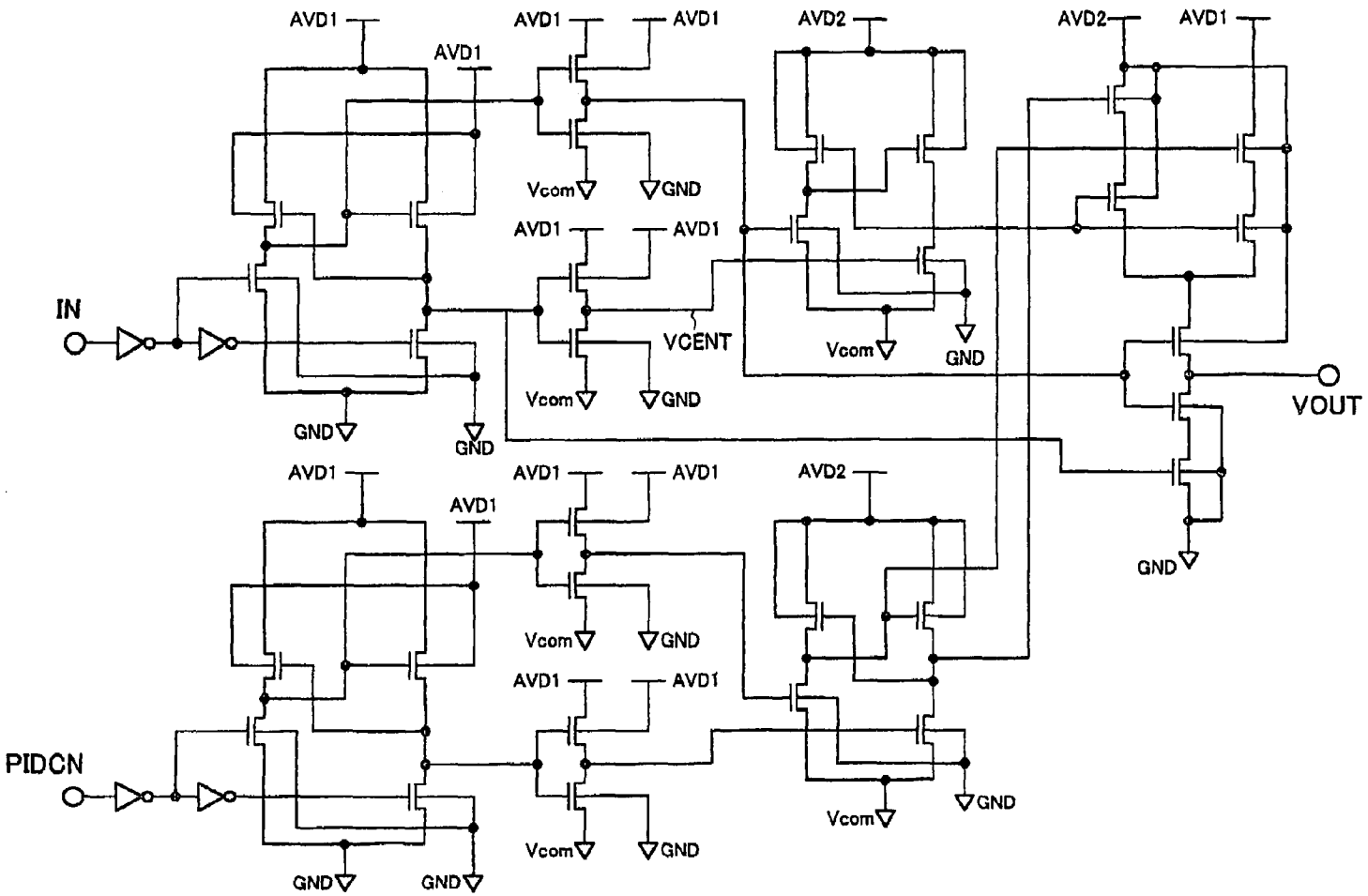
FIG. 4 is a circuit diagram showing an example of an internal configuration of a driver in the present embodiment.

FIG. 4 shows an example of an internal configuration of each of the drivers (YV1 to YVm and YH1 to YHn) provided in the scanning driver 2 and the data driver 4. The drivers (YV1 to YVm and YH1 to YHn) commonly adopt the configuration shown in the figure.

Here, while description of a detailed connection form and detailed functions of the different portions of the circuits is omitted, it is recognized that N-channel or P-channel transistors are connected in such a manner as shown in the figure, and besides, as an operation power supply, a voltage AVD1 or AVD2 is connected to a required transistor and the required transistor is connected to the ground (GND) or the common voltage Vcom thereby to form a circuit as a driver.

In the circuit of the driver formed in this manner, a scanning signal is inputted to an input terminal IN. Further, a signal obtained by latching the polarity signal PID is inputted to a PID input terminal PIDCN. Then, an output voltage is obtained from an output terminal VOUT.

More particularly, for example, in the driver YV1 of the scanning driver 2, the scanning signal V1 is inputted from the vertical shift register 3 to the input terminal IN, and an output voltage to be supplied from the scanning line LV1 to the gate of the pixel switch SW is obtained at the output terminal VOUT. Meanwhile, for example, in the driver YH1 of the data driver 4, the scanning signal H1 is inputted from the horizontal shift register 5 to the input terminal IN, and an output voltage to be supplied to the gate of the sampling switch SSW1 is obtained at the output terminal VOUT. Further, a signal from the PID input terminal PIDCN is supplied to the drivers to control changeover of the voltage level between a voltage AVD1 and another voltage AVD2 which are hereinafter described.

Figures 5A, 5B, 5C, 5D:
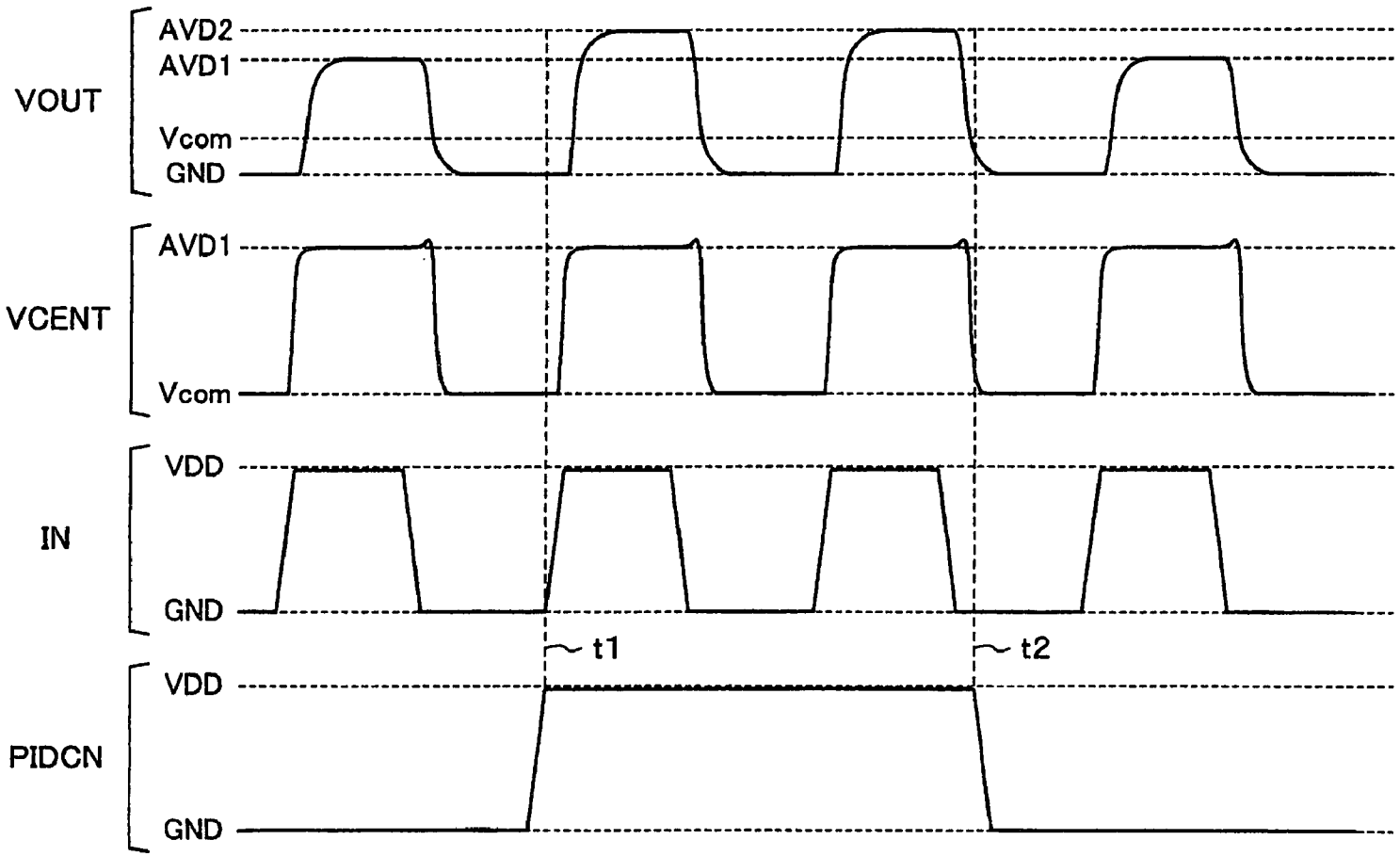
FIGS. 5A to 5D are waveform diagrams illustrating operation of the driver.

Waveform diagrams of FIGS. 5A to 5D illustrate operation of the driver shown in FIG. 4. To the input terminal IN, a scanning signal having a level of a predetermined voltage VDD with reference to the ground potential (GND) as shown in FIG. 5C is inputted. Further, the signal obtained by latching the polarity signal PID inputted to the PID input terminal PIDCN exhibits the ground potential when the latched level is the L level, but exhibits the level of the voltage VDD when the latched level is the H level as shown in FIG. 5D.

Further, at a line to which VCENT is outputted in the circuit shown in FIG. 4, a waveform according to a timing in accordance with the scanning signal inputted to the input terminal IN appears as shown in FIG. 5B. In short, when the scanning signal has the ground potential, the signal VCENT has the common voltage Vcom, but when the scanning signal rises to the level of VDD, the signal VCENT rises to the level of AVD1.

Here, the relationship in level of the common voltage Vcom, voltage AVD1 and voltage AVD2 with respect to the ground potential GND is GND<Vcom<AVD1<AVD2 as shown in FIG. 5A. The common voltage Vcom is a voltage level applied to the opposing voltage as described hereinabove. Further, the voltage AVD1 is a level substantially equal to the gate withstanding voltage of the transistor of the pixel switch SW and is a level with which the withstanding voltage is not exceeded even if the voltage AVD1 is applied to the pixel switch SW. In contrast, the voltage AVD2 has a level higher than the gate withstanding voltage of the transistor of the pixel switch SW.

Then the voltage level obtained at the output terminal VOUT varies in response to the level of the latch signal inputted to the PID input terminal PIDCN in such a manner as illustrated in FIG. 5A.

In particular, when the latch signal has the L level, the level of the voltage AVD1 is outputted before time t1 or after time t2 as seen from the waveform of FIG. 5A. On the other hand, when the latch signal has the H level, the level of the voltage AVD2 is outputted within the period from t1 to t2 as seen from the waveform of FIG. 5.

In short, the driver in the present embodiment outputs the voltage AVD1 equal to or lower than the gate withstanding voltage when the data signal polarity is the negative polarity (latch signal=L), but outputs the voltage AVD2 higher than the gate withstanding voltage when the data signal polarity is the positive polarity (latch signal=H).

It is to be noted that, in the driver shown in FIG. 4, in order to allow changeover of the voltage level to be outputted from the output terminal VOUT between AVD1 and AVD2, the voltages AVD1 and AVD2 are used for the power supply voltage. However, according to the connection scheme shown in FIG. 4, the gate-drain voltage and the gate-source voltage of each of the transistors which form the driver remain within the voltage AVD1, and consequently, the voltage AVD2 higher than this is not applied to the transistors at all.

From this, also each of the transistors which form the drivers may be formed to have, for example, a gate withstanding voltage similar to that of the pixel switches SW. Based on this, for example, the transistors which form the drivers and the transistors which form the pixel switches may be produced using a similar semiconductor process, and therefore, the efficiency in manufacture of semiconductor substrates is raised as much.

Further, in the present embodiment, the operation of the drivers of changing over the output level between AVD1 and AVD2 in response to the latch signal in such a manner as described hereinabove is combined with the frame reversal method and the display driving timing which involves a precharging operation within a horizontal blanking period to achieve the following operation unique to the present invention.

First, depending upon the operation of the drivers (YV1 to YVm) on the scanning driver 2 side, each of the pixel switches SW can be driven such that the voltages applied between the gate and the drain and between the gate and the source of the pixel switch SW are included within the withstanding level while a gate voltage higher than the gate withstanding voltage is applied between the gate of the pixel switch SW and the substrate. In other words, a gate voltage higher than the withstanding voltage can be applied to the pixel switch SW while the pixel switch SW is not broken by a voltage exceeding the withstanding voltage.

Further, depending upon the operation of the drivers (YH1 to YHn) on the data driver 4 side, the sampling switches SSW1 to SSWn can be switched on/off by application of a gate voltage higher than the gate withstanding voltage.

For example, it is assumed that the polarity signal PID shown in (c) of FIG. 3 reverses from the L level to the H level at a timing of the horizontal clock signal HCK(1) in the timing chart of FIG. 3. This corresponds to a condition that the data signal whose polarity has been the negative polarity within a preceding frame period including a preceding horizontal scanning period reverses to the positive polarity within a current frame period including a current horizontal scanning period.

In this instance, until after the polarity signal PID of the reversed polarity is latched at a timing of the horizontal clock signal HCK(9), a latch signal of the L level is inputted to the PID input terminal PIDCN of the driver as illustrated in (j) of FIG. 3. Therefore, to the scanning line LVm, the voltage AVD1 is applied from the driver YVm as illustrated in (f) of FIG. 3. Accordingly, at this time, the pixel switches SW connected to the scanning line LVm are in an on-state.

Then, if a precharge period of the horizontal clock signal HCK(7) thereafter starts, then precharging of the data lines LH1 to LHn is performed at a time as described hereinabove, and consequently, the potential between the source and the drain of each of the pixel switches SW connected to the scanning line LVm is pulled up to a potential substantially equal to the precharge voltage Vpre.

Then, at a timing of the horizontal clock signal HCK(9) within the same precharge period, the polarity signal PID is latched, and at this time, the latch signal illustrated in (j) of FIG. 3 reverses from the L level to the H level. In response to the reversal, the driver YVm changes over the output level from the voltage AVD1 to the voltage AVD2 as illustrated in (f) of FIG. 3.

Consequently, a voltage of a level higher than the gate withstanding voltage is applied to the pixel switches SW connected to the scanning line LVm. However, since the precharging has been performed with the precharge voltage Vpre within the front half of the precharge period by HCK(7) and HCI(8), for example, the gate-source voltage Vgs and the gate-drain voltage Vgd of each of the pixel switches SW are represented, where the gate voltage applied to the gate is represented by Vg, by $$Vgs=Vgd=Vg-Vpre \quad \text{(expression 1)}$$

In short, the gate-source voltage Vgs and the gate-drain voltage Vgd can be controlled to a level within the gate withstanding voltage although the voltage AVD2 higher than the withstanding voltage is applied to the gate.

Also the drivers YH1 to YHn on the data driver 4 side operate similarly to the driver YVm described hereinabove, and output the voltage AVD2 when the latch signal of the polarity signal PID has the H level, but output the voltage AVD1 when the latch signal of the polarity signal PID has the L level.

Then, when the drivers YH1 to YHn output the voltage AVD2 in response to inputs of the scanning signals H1 to Hn, respectively, the data lines LH1 to LHn are in a state charged to the potential of the precharge voltage Vpre or discharged to the potential based on the positive polarity data applied thereto by the precharging operation within the preceding precharge period described above.

Accordingly, also the gate-source voltage Vgs and the gate-drain voltage Vgd of each of the sampling switches SSW1 to SSWn, to which the outputs of the drivers YH1 to YHn are applied as gate voltages, are represented by the expression 1 given hereinabove. In short, even if the voltage AVD2 higher than the withstanding voltage is applied as the gate voltage to each of the sampling switches SSW1 to SSWn, the gate-source voltage Vgs and the gate-drain voltage Vgd have a level within the gate withstanding voltage.

On the contrary, if the data signal which has had the positive polarity within a preceding horizontal scanning period (preceding frame) reverses to the negative polarity within the current horizontal scanning period (current frame), whereupon the polarity signal illustrated in (c) of FIG. 3 reverses from the H level to the L level at the timing of the horizontal clock signal HCK(1), the following operation is performed.

In this instance, since, in the preceding horizontal scanning period, the data signal SIG has the positive polarity, until after the polarity signal PID of the L level is latched at the timing of the horizontal clock signal HCK(9) within the current horizontal scanning period, the latch signal of the H level remains inputted to the PID input terminal PIDCN of the driver YVm in the scanning driver 2. Therefore, till the timing of the horizontal clock signal HCK(9) within the horizontal scanning period, the voltage AVD2 higher than the withstanding voltage continues to be outputted from the driver YVm.

At this time, however, since charge corresponding to the data having been written into the pixel capacitor C in the preceding cycle is being discharged, where the gate voltage is represented by Vg and the potential maintained by the pixel capacitor after the writing of the data signal is represented by Vsig, the gate-source voltage Vgs of the pixel switch SW is represented by $$Vgs=Vg-Vsig \quad \text{(expression 2)}$$

and it is possible to prevent the gate-source voltage Vgs from exceeding the withstanding voltage level.

Further, also the gate-drain voltage Vgd can be represented by $$Vgd=Vg-Vpre \quad \text{(expression 3)}$$

Consequently, since the potential precharged within the preceding horizontal period is maintained in the data line, the gate-drain voltage Vgd is prevented from exceeding the withstanding voltage.

Further, also with regard to the sampling switches SSW1 to SSWn, since the data signal SIG has a voltage equal to the common voltage Vcom within a horizontal blanking period HBL, the one side potential between the source and the drain is equal to the common voltage Vcom while the other side potential is a potential corresponding to the precharge voltage Vpre appearing in the data line. Therefore, even if the voltage AVD2 higher than the withstanding voltage is applied to the gate, there is no problem.

Then, after the polarity signal PID of the L level is latched when the timing of the horizontal clock signal HCK(9) is reached, the voltage AVD1 is outputted from the driver YVm in the scanning driver 2. Then, thereafter, line scanning is performed such that each of the pixel switches SW is switched on with the level of the voltage AVD1.

If the data signal has the negative polarity, then the maximum value Vnmax of the negative polarity, for example, illustrated in FIG. 2 is, for example, the 0 voltage level. However, when a data signal having such an absolutely low level is written, if the voltage AVD2 higher than the withstanding voltage is applied, then the pixel switch SW is subject to the voltage higher than the withstanding voltage. Therefore, in the present embodiment, the output level is changed over such that, when the data signal has the negative polarity, the voltage AVD1 within the withstanding voltage may be applied in such a manner as described hereinabove.

Further, sine also the drivers YH1 to YHn on the data driver side operate such that the voltage AVD1 is applied in a similar manner, even if a data signal, for example, of the 0 voltage level or the like is written, the sampling switches SSW1 to SSWn do not suffer from a voltage higher than the withstanding voltage as well.

In this manner, in the present embodiment, a gate voltage of a level higher than the withstanding voltage can be applied to the pixel switches while at least the pixel switches are prevented from being electrically broken. Consequently, the on-resistance of the transistors of the pixel switches is reduced and electric conduction of them is improved.

As a result, a higher writing speed into pixel capacitors than ever can be achieved readily.

Besides, in the present embodiment, since a potential difference is caused to appear between the potential of a precharged data line and a pixel capacitor and the gate voltage to make application of a gate voltage higher than the withstanding voltage possible, a withstanding voltage similar to that in the prior art can be used in a semiconductor process for the pixel switches and so forth. In other words, the size of the pixel switches is not increased in order to form a semiconductor process wherein the withstanding voltage is raised.

From this, if it is assumed, for example, that a voltage level similar to that in the prior art may be applied to the pixel switches, then the withstanding voltage in the semiconductor process may be decreased, and as the withstanding voltage drops, the size in the semiconductor process can be reduced.

From the foregoing, it can be said that, where the display driving method of the present embodiment is adopted, while the semiconductor process involves a withstanding voltage and a size similar to those in the prior art, a voltage higher than the withstanding voltage can be applied to achieve data writing at a higher speed than ever. Accordingly, a high refresh rate can be achieved readily, and increase in definition and miniaturization of a liquid crystal display apparatus can be achieved more readily than ever.

Further, since a semiconductor process, for example, similar to that in the prior art can be used while higher speed data writing can be achieved, the display driving method of the present embodiment is advantageous also in terms of the cost when compared with that in an alternative case wherein a semiconductor process of a high withstanding voltage is newly designed or developed.

Furthermore, if the data writing speed may be equivalent to that in the prior art by application of a gate voltage equivalent to that in the prior art, then since the size in the semiconductor process can be further reduced, where performances equivalent to those in the prior art are required, a display apparatus of a smaller size can be provided readily.

Further, it is known that, from the characteristics of a substrate process of a liquid crystal display apparatus, a back bias is applied to transistor elements formed on a semiconductor substrate beginning with, for example, pixel switches and so forth. Even if a gate voltage of, for example, approximately 12 V is applied, a transistor element operates effectively only within a range reduced to, for example, a range from 0 V to approximately 8 V due to the back bias. If the range of the gate voltage amplitude of, for example, a pixel switch is narrowed as just described, then also the variation width of the potential in accordance with the data signal decreases, and consequently, the pixel switch cannot be driven so as to extract the characteristic of the liquid crystal sufficiently.

Furthermore, while the liquid crystal is excited reactively when a voltage is applied thereto, as well known in the art, the liquid crystal has a threshold voltage with respect to the applied voltage thereto as shown in FIG. 2. In other words, in order to cause the liquid crystal to operate such that the transmission factor thereof varies in response to the applied voltage, the applied voltage must be applied within a predetermined range higher than the threshold voltage. Also this narrows the range within which the gate voltage can drive the liquid crystal effectively.

If the amplitude range for driving the liquid crystal is narrowed in this manner, then this deteriorates the gradation representation. Particularly with a liquid crystal display apparatus which displays an image in full colors, the color reproducibility is low if the gradation representation is not good.

Therefore, if the configuration of the present embodiment is used such that a gate voltage of a higher level is applied to the pixel switches, then reduction of the amplitude range by an influence of the back bias and the threshold voltage of the liquid crystal can be compensated for, and therefore, the gradation representation performance and the color reproducibility can be improved readily.

Incidentally, according to the configuration of the embodiment described above, when the data signal SIG has the negative polarity, a gate voltage higher than the withstanding voltage is not applied. This is based on the following foundation.

The maximum frequency of a liquid crystal display apparatus is determined by the writing speed of data into a pixel capacitor.

Here, if, for example, an N-channel transistor is taken as an example, then if the voltage of the data signal is set higher, then the potential difference between the gate and the source becomes smaller from the nature of the N-channel transistor, and therefore, the on-resistance of the transistor becomes very high. Therefore, the charging and discharging speeds of the pixel capacitor into which data is written are decreased. In other words, when the data signal is a positive polarity signal and the voltage value level becomes high, the data writing speed drops. On the other hand, when the data signal has the negative polarity and has a low level, a sufficient potential difference between the gate and the source is obtained, and therefore, high data writing is possible originally. In short, where the data signal has the negative polarity, there is no necessity to intentionally adopt a configuration for increase of the speed.

As regards the data writing time period corresponding to the data writing speed, usually a writing time period by a data signal of the positive polarity and a writing time period by a data signal of the negative polarity are collectively regarded as a unit. Accordingly, if the foregoing is taken into consideration, in order to raise the data writing speed, it is demanded to raise the data writing speed when the data signal is a positive polarity signal and the voltage value level becomes high. Therefore, also in the present embodiment, only when the data signal has the positive polarity, a gate voltage higher than the gate withstanding voltage is applied to achieve increase of the speed of data writing.

It is to be noted that it is described here, for the confirmation, that, although precharging itself is applied also in the prior art, such conventional precharging is used only in order to reduce and optimize the amount of charge to be charged into and discharged from a pixel capacitor upon data writing by merely precharging a data line to a certain voltage level.

In contrast, the present embodiment includes a driver which performs a precharging operation at the timing specified as above and can change over the output level between the voltage AVD1 which is within the withstanding voltage and the voltage AVD2 higher than the withstanding voltage, and performs timing control and so forth with various signals for the changeover of the output level of the driver to apply a gate voltage higher than the withstanding voltage thereby to promote increase of the speed of data writing.

Further, the present invention is not limited to the configuration of the embodiment described hereinabove. For example, for the transistor elements of the pixel switches, sampling switches and so forth and the transistor elements which form the drivers, for example, CMOS transistors can be used in addition to N-channel or P-channel transistors.

Further, while, in the embodiment described above, the output voltage levels of the scanning driver 2 and the data driver 4 are both changed over from the voltage AVD1 to the voltage AVD2, the levels of the voltages may be different between the scanning driver 2 and the data driver 4.

Further, while, in the embodiment described above, the changeover of the voltage level from the voltage AVD1 to the voltage AVD2 is performed within a precharge period PCH which is a period within which the precharge voltage Vpre is applied as can be seen from (a) and (f) of FIG. 3, the changeover between the voltage AVD1 and the voltage AVD2 may not necessarily be performed within the period within which the precharge voltage Vpre is applied.

In particular, for example, even after the period within which the precharge voltage Vpre is applied comes to an end, the changeover from the voltage AVD1 to the voltage AVD2 may be performed at a timing within a period within which the potential produced in the pixel capacitors C and data lines by a precharging operation is maintained higher than a fixed level. The object of the application of the precharge voltage Vpre is that, as can be recognized from the foregoing description of the embodiment, a state wherein a potential higher than a fixed level is held in the pixel capacitor C and the data lines is produced before the changeover from the voltage AVD1 to the voltage AVD2 is performed. Accordingly, also with the changeover timing described above, an operation of applying a gate voltage higher than the gate withstanding voltage can be obtained appropriately.

Furthermore, while, in the embodiment described above, it is a prerequisite that the data signal is reversed for each frame by the frame reversal method, by setting the precharge timing and so forth in accordance with the reversal timing of the data signal, display driving by some other reversal method such as, for example, the line reversal method or the dot reversal method can be applied. Also a reversal method which is a combination of some of such reversal methods can be applied.

As described above, according to the present invention, it becomes possible to apply a scanning signal voltage (gate voltage) higher than a withstanding voltage to a switching element (pixel switch) for driving a pixel cell while, for example, the potential difference between predetermined terminals of the switching element is suppressed within the withstanding voltage. Where the scanning signal voltage higher than the withstanding voltage is applied in this manner, for example, the on-resistance of the switching element can be reduced significantly so that charging and discharging of a data signal into and from the pixel capacitor can be performed at a higher speed.

For example, according to the prior art, if it is intended to apply a higher scanning signal voltage, then it is necessary to modify the specifications of a semiconductor process for the display element so that the display element may have a higher withstanding voltage, and this is disadvantageous also in terms of the cost. Further, increase in size of the semiconductor process cannot be avoided. According to the present invention, however, the speed of data writing into a pixel capacitor can be further raised while the specifications of the semiconductor process remain as they are. Accordingly, according to the present invention, increase of the number of pixels per unit area can be achieved readily, and improvement of the picture quality by increase of the definition and miniaturization of a liquid crystal display apparatus can be promoted.

Further, if it is assumed that, for example, the data writing speed may be equal to that in the prior art, that is, the scanning signal voltage may have a level equivalent to that in the prior art, then the semiconductor process can be further reduced in size, and the present invention is much advantageous in terms of the miniaturization.

Furthermore, since it is possible to compensate for narrowing of the range of the scanning signal voltage, for example, by a so-called back bias effect, it is possible to apply the data signal with a high degree of accuracy to the pixel capacitor. By this, it is possible to improve the gradation representation performance and the color reproducibility, and a display apparatus having a higher image quality can be provided.

The invention claimed is:

1. A display driving method for a display element wherein a plurality of scanning lines and data lines extending perpendicularly to said scanning lines for being supplied with a data signal corresponding to pixel data are disposed in a matrix and, at each of intersecting points between said scanning lines and said data lines, a pixel capacitor and a switching element for rendering conducting a route for supplying the data signal to said pixel capacitor by a scanning signal voltage applied to said scanning line are connected, the method comprising the steps of:

a scanning step of starting application of the scanning signal voltage with a first amplitude level which is within an allowable level based on a withstanding voltage characteristic of said switching element;

a precharging step of applying a precharge voltage of a predetermined level to said data lines before supply of data to said data lines is started after application of the scanning signal voltage of the first amplitude level is started;

an amplitude changeover step of changing over the scanning signal voltage being applied with the first amplitude level to a second amplitude level larger than the first amplitude level at a predetermined timing within a period within which a potential generated by the application of the precharge voltage is maintained, wherein said amplitude change over step changes the scanning signal voltage to said second amplitude level when said data signal has a predetermined polarity, and said second amplitude level exceeds the allowable level; and an application step of applying, when the scanning signal voltage of the first amplitude level is applied, an on/off control signal voltage of a third amplitude level which is within an allowable level based on a withstanding voltage characteristic of a data signal switching element.

2. The display driving method according to claim 1, further comprising:

wherein said application step applies said on/off control signal voltage to an on/off control signal terminal of said data signal switching element which switches on/off a route for supplying the data signal to said data lines in response to a timing at which said data lines are scanned; and applying, when the scanning signal voltage of the second amplitude level is applied, the on/off control signal voltage of a fourth amplitude level larger than the third amplitude level.

3. A display element wherein a plurality of scanning lines and data lines extending perpendicularly to said scanning lines for being supplied with a data signal corresponding to pixel data are disposed in a matrix and, at each of intersecting points between said scanning lines and said data lines, a pixel capacitor and a switching element for rendering conducting a route for supplying the data signal to said pixel capacitor by a scanning signal voltage applied to said scanning line are connected, comprising:

scanning line driving means for supplying a scanning signal voltage for scanning said scanning lines;

data line driving means for supplying the data signal to said data lines;

precharge means for applying a precharge voltage of a predetermined level to said data lines before supply of data to said data lines is started after application of the scanning signal voltage of a first amplitude level is started, wherein said scanning line driving means changes over the scanning signal voltage between the first amplitude level which is within an allowable level based on a withstanding voltage characteristic of said switching element and a second amplitude level larger than the first amplitude level at a predetermined timing within a period within which a potential generated by the application of the precharge voltage is maintained and applies the scanning signal voltage to said scanning lines, and wherein said scanning line driving means changes the scanning signal voltage to said second amplitude level when said data signal has a predetermined polarity, and said second amplitude level exceeds the allowable level; and switching element driving means for applying, when the scanning signal voltage of the first amplitude level is applied, an on/off control signal voltage of a third amplitude level which is within an allowable level based on a withstanding voltage characteristic of a data signal switching element.

4. The display element according to claim 3, wherein said data signal switching element switches on/off of a route which the data signal is to be supplied to said data lines;

wherein said switching element driving means applies said on/off control signal voltage for controlling said data signal switching element on/off in response to a scanning timing of the data signal, said switching element driving means adapted to switch the on/off control signal voltage between said third amplitude level and a fourth amplitude level larger than the third amplitude level, and wherein said switching element driving means outputs the fourth amplitude level when the scanning signal voltage of the second amplitude level is applied.

5. The display element according to claim 3, wherein said display element is of the reflection type.

6. A display apparatus, comprising:

a semiconductor substrate on which a display element is formed;

an opposing substrate having a common electrode disposed in an opposing relationship to said semiconductor substrate; and a liquid crystal layer interposed between said semiconductor substrate and said opposing substrate, wherein said display element includes a plurality of scanning lines and data lines extending perpendicularly to said scanning lines for being supplied with a data signal corresponding to pixel data are disposed in a matrix and, at each of intersecting points between said scanning lines and said data lines, a pixel capacitor and a switching element for rendering conducting a route for supplying the data signal to said pixel capacitor are connected;

scanning line driving means for supplying a scanning signal voltage for scanning said scanning lines;

data line driving means for supplying the data signal to said data lines;

precharge means for applying a precharge voltage of a predetermined level to said data lines before supply of data to said data lines is started after application of the scanning signal voltage of a first amplitude level is started, wherein said scanning line driving means changes over the scanning signal voltage between the first amplitude level which is within an allowable level based on a voltage characteristic of said switching element and a second amplitude level larger than the first amplitude level at a predetermined timing within a period within which a potential generated by the application of the precharge is maintained and applies the scanning signal voltage to said scanning lines, and wherein said scanning line driving means changes the scanning signal voltage to said second amplitude level when said data signal has a predetermined polarity, and said second amplitude level exceeds the allowable level; and switching element driving means for applying, when the scanning signal voltage of the first amplitude level is applied, an on/off control signal voltage of a third amplitude level which is within an allowable level based on a withstanding voltage characteristic of a data signal switching element.

7. The display apparatus according to claim 6, wherein said data signal switching element switches on/off of a route along which the data signal is to be supplied to said data lines;

wherein said switching element driving means applies said on/off control signal voltage for controlling said data signal switching element on/off in response to a scanning timing of the data signal, said switching element driving means being capable of switching the on/off control signal voltage between said third amplitude level and a fourth amplitude level larger than the third amplitude level, and said switching element driving means outputs the fourth amplitude level when the scanning signal voltage of the second amplitude level is applied.

8. The display apparatus according to claim 6, wherein said display element is of the reflection type.

* * * * *